United States Patent [19]

Manizza et al.

[11] 4,250,991

[45] Feb. 17, 1981

[54] BOTTLE CARRIER

[75] Inventors: Guelfo A. Manizza, Blauvelt, N.Y.; George S. Holmes, Waldwick, N.J.

[73] Assignee: Federal Paper Board Company, Inc., Montvale, N.J.

[21] Appl. No.: 67,581

[22] Filed: Aug. 17, 1979

[51] Int. Cl.[3] ..... B65D 85/62; B65D 71/00; B65D 75/00

[52] U.S. Cl. ..... 206/158; 206/153; 206/427; 294/87.2; 229/52 BC

[58] Field of Search ..... 206/158, 153, 145, 147, 206/427; 229/52 BC; 294/87.2

[56] References Cited

U.S. PATENT DOCUMENTS

| | | | |
|---|---|---|---|
| 2,737,326 | 3/1956 | Toensmeier | 206/153 |
| 3,016,259 | 1/1962 | Lawrence | 206/153 |
| 3,123,213 | 3/1964 | Kulig | 206/158 |
| 3,528,697 | 9/1970 | Wood | 294/87.2 |
| 3,815,647 | 6/1974 | Olsen | 206/158 |
| 3,860,281 | 1/1975 | Wood | 206/158 |
| 3,926,307 | 12/1975 | Klygis | 206/153 |

*Primary Examiner*—William T. Dixson, Jr.

*Attorney, Agent, or Firm*—Guy A. Greenawalt

[57] ABSTRACT

A carrier package arrangement adapted for marketing bottled beverages or similar articles formed by securing on the top portions of a plurality of bottles arranged in a double row a carrier device which is formed by folding a cut and scored blank of paperboard, or similar material, into a tube with a generally rectangular cross section and securing the device on the tops of the bottles so as to engage the neck of each bottle in a position defining aperture in a base forming bottom panel of the device with downwardly directed flange formations on the cap on the top of each bottle engaging upwardly facing edge formations defining openings at the top fold line of upwardly converging wall forming panels which are arranged in paired relation and extend along opposite sides of the tube, with a top panel of the device extending between bottom edges of the innermost wall forming panels and having portions thereof secured to the base forming bottom panel which are scored, so as to fold downwardly in accordian fashion. In another form of the carrier, the top wall panel is scored so that portions fold upwardly in accordian fashion when the carrier is applied to the bottles.

14 Claims, 15 Drawing Figures

BOTTLE CARRIER

BACKGROUND OF THE INVENTION

This invention relates to packaging and is more particularly concerned with improvements in the packaging of bottled beverages, or other articles having a bottle-like configuration, wherein the package is formed by folding a blank of paperboard or similar sheet material into a tube formation and securing the same on the top portions of a group of the articles which are arranged in double row formation with cap skirts or other downwardly facing abutment forming means adjacent the top which abutment forming means may be utilized to engage upwardly facing edge portions of wall formations of the tube formation so that the tube formation may be grasped and the weight of the articles carried by the wall formations.

In the packaging of bottled products, such as beer and other beverages, particularly, consumer packages of multiple units arranged in double row relation, carriers formed of foldable sheet material, such as paperboard, have been provided, heretofore, in which the bottles are supported by engaging skirt portions of the bottle closure caps, or a projected annular bead adjacent the mouth of each bottle, with upwardly facing edge portions of oppositely disposed sidewall elements of the carrier device. This type package has the advantage of economy in the use of materials and storage space, and generally, in ease of application to the bottle group. However, this type of carrier has not heretofore been fully acceptable for double row bottle assemblies, for a number of reasons. One difficulty encountered has been an inability to provide a satisfactory design which will hold the bottles with sufficient rigidity to prevent damaging contact between the bottles when carried and which is sufficiently rugged and durable for group packaging of different size bottles, some of which may be quite heavy when filled with the liquid product. Consequently, there has been a need for an improved packaging arrangement of this type which is more rugged and more dependable than heretofore provided, which can be produced with maximum economy in the use of materials and which lends itself to relatively simple machine application.

It is a general object of the invention to provide an improved bottle carrier of the top gripping type which may be formed from a single sheet of foldable paperboard, or similar material, with maximum economy of materials and with provision for securely gripping the bottles at the top thereof and for holding them in vertical position with their vertical axes in generally parallel relation and with minimum risk of damage due to contact of body portions below the bottle necks.

A more specific object of the invention is to provide an improved bottle carrying package assembly wherein a top gripping and carrying device is formed from sheet material folded into a tube of substantially rectangular cross section with a bottom forming wall panel having spaced apertures of a size to snugly engage around the bottle necks at a substantial distance below the tops of the bottles and with pairs of upwardly converging wall panels which have spaced apertures at their top edges in vertical alignment with the apertures in the bottom wall forming panel, which converging wall apertures are defined in part by upwardly facing edge formations positioned to engage beneath oppositely disposed portions of an annular cap skirt formation, or like abutment forming means, disposed adjacent the tops of the bottles.

Another object of the invention is to provide a bottle top gripping and carrying device of the type described wherein pairs of upwardly converging wall panels having the cap engaging edge formations are connected in spaced relation at the base thereof by a multiple thickness of the panel material which is disposed in the plane of the bottom wall panel, which is spaced a substantial distance below the cap engaging edge formations and which is secured in double panel relation so as to rigidify the carrier.

An additional object of the invention is to provide an improved article packaging arrangement wherein articles having the general form of bottles are adapted to be packaged by attaching thereto a top gripping carrier device which is formed from a cut and scored blank of foldable sheet material and which may be initially formed in folded condition enabling it to be set up into a tube of generally rectangular cross section and having a bottom wall panel with bottle neck receiving apertures and upstanding relatively narrow wall panels with bottle cap gripping apertures at the top of upwardly converging pairs thereof, and the bottom edges of the outermost wall panels being hinged to the outside edges of the bottom wall while the innermost panels are hinged to the top edges of the outermost panels and connected to a top wall panel which lies on the intervening portion of the bottom wall panel.

A further object of the invention is to provide a packaging and carrying device for a group of bottles which are arranged in double row and transversely paired relation, wherein the device is formed from a blank of paperboard, or similar sheet material, which is cut and scored so that its ends may be connected to form a collapsed tube of rectangular cross sectional configuration when opened up and applied to the top portions of the bottles with the axis thereof extending in the direction of the rows of bottles, the tube comprising a bottom wall forming panel, with a double row of apertures which are spaced in the rows and dimensioned to seat on neck portions of the bottles and a pair of axially extending, upwardly converging wall panels which are upstanding in vertical planes extending along opposite lateral edges of the apertures in each row thereof, which wall panels are hingedly connected at their top edges and have axially spaced apertures at the hinge line in vertical alignment with the apertures in the bottom wall panel and which include edge formations configured so as to engage beneath downwardly facing skirt edges on the bottle caps, the outermost wall panel of each pair thereof being hinged at the bottom edge to the outermost edge of the bottom wall forming panel and the associated innermost panel being hinged to a top wall forming panel which bridges the space between the pairs of vertical panels and lies on the top face of the central portion of the bottom wall forming panel, with the top and bottom wall panels being cut and scored so as to buckle in accordian fashion inwardly in the axial direction when applied to the bottles thereby to afford greater rigidity to the carrier.

A still further object of the invention is to provide a packaging and carrying device of the cap gripping type described wherein top and bottom wall forming panels are tied together by hinged tabs cut in the top wall panel and turned in locking relation into cooperating apertures in the bottom wall forming panel.

To this end, the invention as claimed herein is embodied in a carrier device for articles having a bottle configuration, which device is formed from paperboard, or other foldable sheet or web material, cut and scored so as to enable it to be formed into a tube of generally rectangular cross section with a bottom forming wall apertured to engage over the neck forming portions of the articles and with upstanding walls in paired, upwardly converging relation which are apertured at the top fold line so as to provide edge formations which engage in gripping and supporting relation beneath downwardly facing portions of cap skirts or other abutment formations adjacent the top of the articles.

The aforesaid objects and other objects and advantages of the invention will become more apparent when reference is made to the accompanying detailed description of the preferred embodiments of the invention which are set forth therein, by way of example, and shown in the accompanying drawings wherein like reference numbers indicate corresponding parts throughout.

DESCRIPTION OF THE PREFERRED EMBODIMENTS OF THE INVENTION

Figure 2:
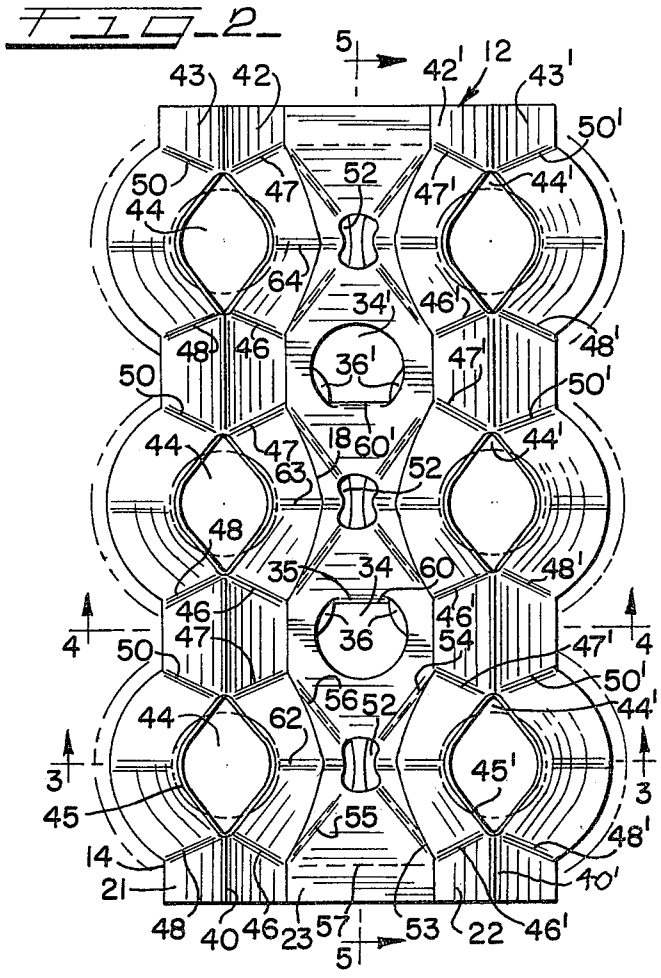
FIG. 2 is a top lan view, to a larger scale, of the carrier of FIG. 1.

Referring to the drawings, there is illustrated in FIGS. 1 to 7 a carrier device for a group of beverage bottles B, which may be soft drink bottles of a type recently introduced and which are closed by caps C with depending skirts S when in filled condition. The carrier is particularly adapted to be fabricated by cutting and scoring a sheet or web of paperboard of the weight corresponding to that commonly employed in basket type and wraparound carrier packages for marketing bottled products, and to be applied to a group of the bottles arranged in double row and transversely paired relation.

Figure 1:
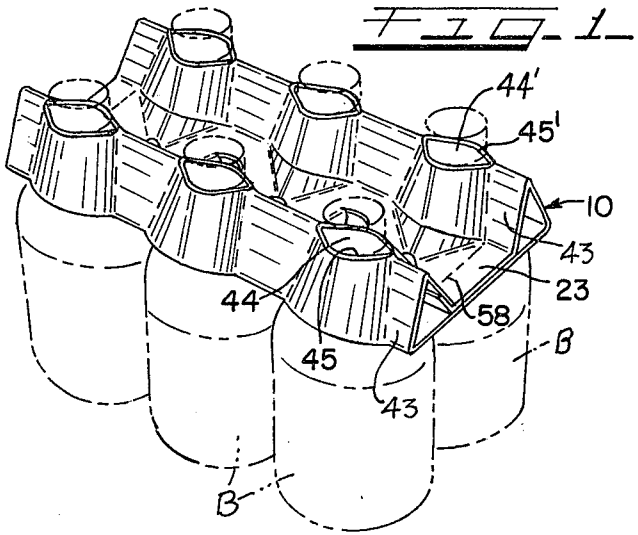
FIG. 1 is a perspective view of a carrier for a double row of beverage bottles which embodies the principles of the invention, with the bottles indicated in phantom lines.
Figure 6:
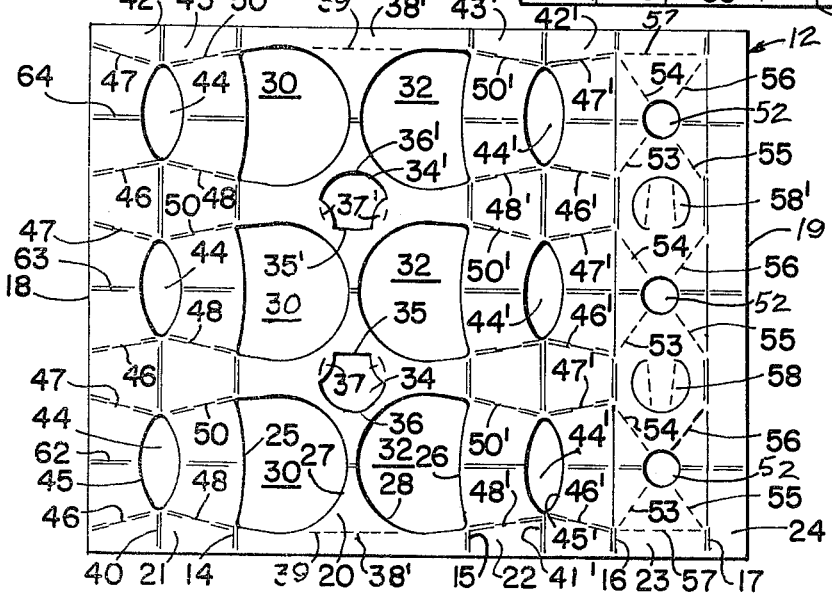
FIG. 6 is a plan view of a cut and scored blank for forming the bottle carrier of FIG. 1.
Figure 9:
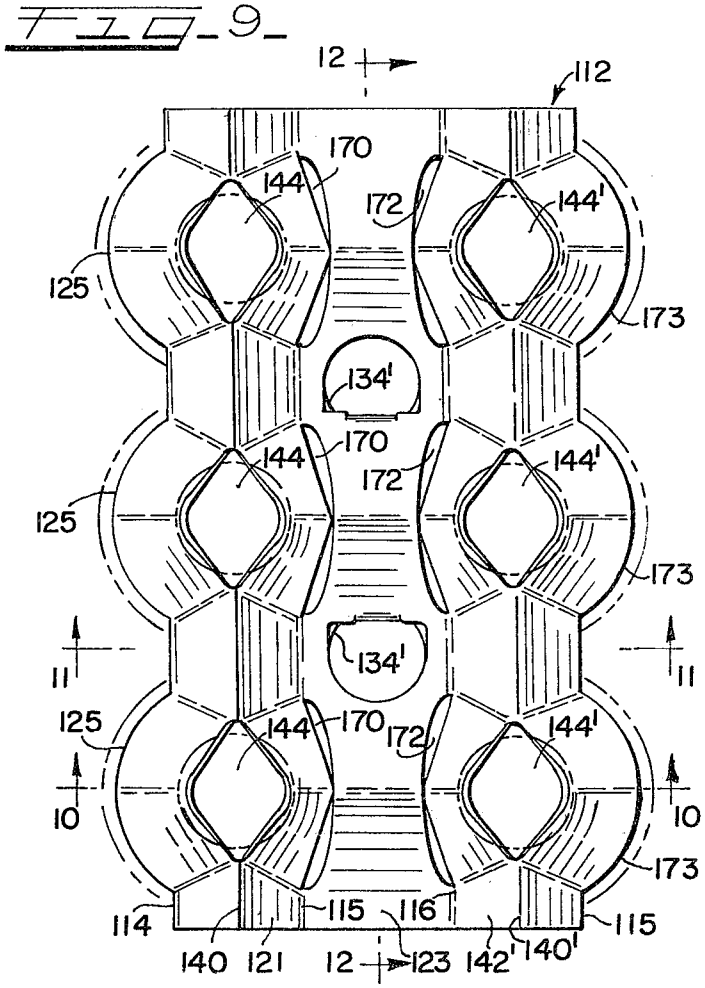
FIG. 9 is a top plan view to a larger scale of the carrier of FIG. 8.
Figure 8:
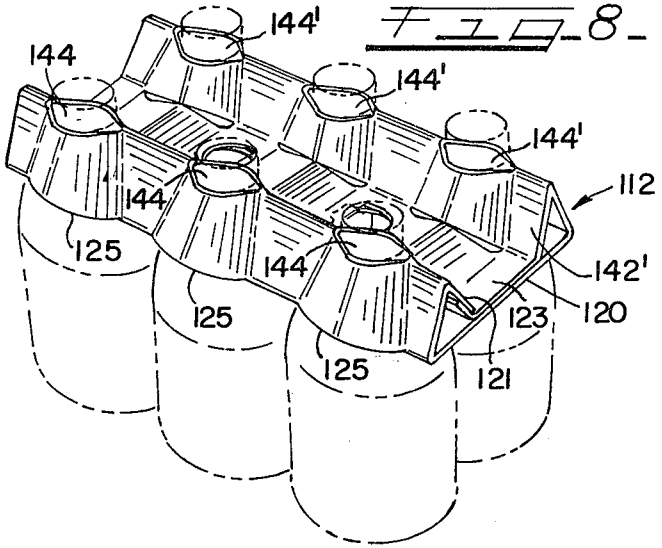
FIG. 8 is a perspective view of a modified form of the carrier.
Figure 10:
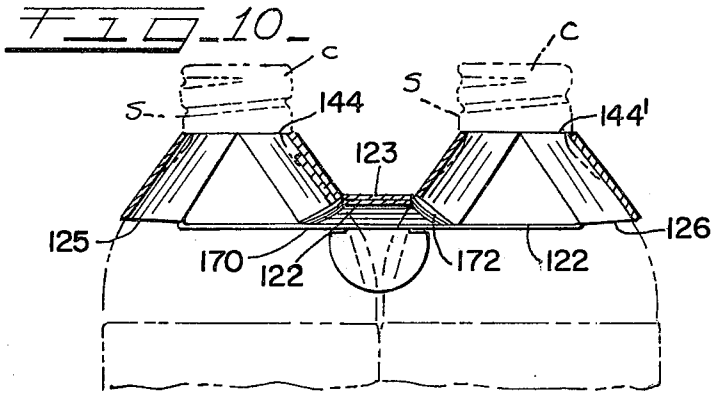
FIG. 10 is a cross sectional view taken on the line 10—10 of FIG. 9.

In the form of the carrier 10 which is illustrated in FIG. 1, a generally rectangular blank 12 of paperboard, or other suitable sheet material of similar character and of a gauge or weight sufficient to provide the desired strength, is cut and scored or creased, as shown in FIG. 6, to provide the bottle receiving aperture formations and panel folding hinge lines which enable fabrication of the carrier and its application to an assembly of Bottles B which are arranged in a double row and in transversely aligned pairs.

Longitudinally spaced, parallel, transverse score or crease lines 14, 15, 16, and 17, which may include short slits or perforations therein, divide the blank 12 into a series of integrally connected rectangular panel forming sections which extend between the parallel edges 18 and 19 of the blank, and which comprise a bottom wall panel forming section 20, adjoining cap gripping wall panel forming sections 21 and 22, which are of equal size, a top wall panel forming section 23 which extends between the score lines 16 and 17, and a relatively narrow connecting glue flap or panel 24 which extends between the score line 17 and the end 19 of the blank 12.

Figure 3:
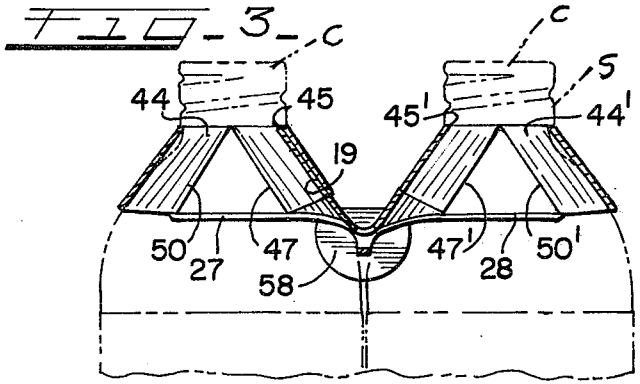
FIG. 3 is a cross sectional view taken on the line 3—3 of FIG. 2.
Figure 5:
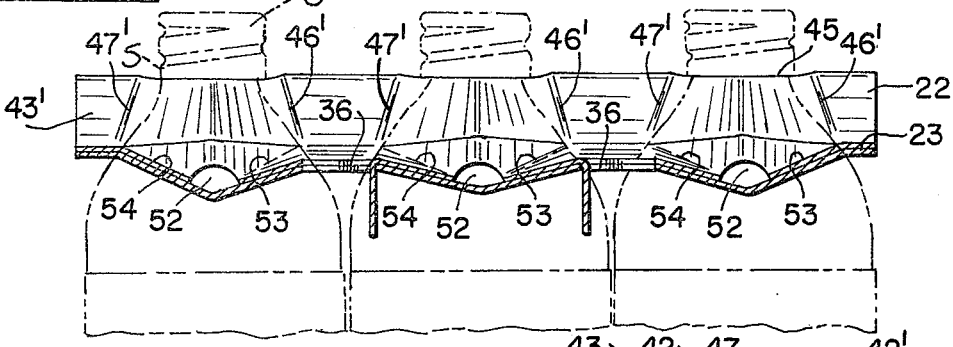
FIG. 5 is a longitudinal sectional view taken on the line 5—5 of FIG. 2.

The transverse score lines 14 and 15, which define the outside edges of the bottom wall panel 20 in the set up carrier device, are each interrupted by three transversely spaced cutting lines 25 and 26 of the same predetermined length which are disposed in spaced and aligned pairs in the direction lengthwise of the blank, and which are slightly bowed in the direction inwardly of the panel 20. The cutting lines 25 and 26 connect at their opposite ends with the ends of generally C-shaped cutting lines 27 and 28, which are bowed in the same direction and to a much greater curvature relative to that of the cutting lines 25 and 26. The cutting lines 25 and 26 together with the cutting lines 27 and 28 define the edges of apertures 30 and 32 which are arranged in two rows of three and in paired relation in the direction of the row length. The cutting lines 27 and 28 extend from the lines 14 and 15 toward the center of the panel 20 and each pair thereof is spaced a small distance apart. Each of the apertures 30 and 32 has a generally semi-circular configuration and the spacing of the same in the two rows thereof is determined by the spacing of the bottles B in the rows so that in the final form of the set up carrier the edges of each aperture may engage a bottle in encircling relation in the tapered area at a predetermined distance below the bottom edge of the cap skirt S, as shown in FIGS. 3 and 5. In addition to the bottle neck accommodating apertures 30, 32, a pair of finger accommodating apertures 34, 34' are cut in transversely spaced and aligned relation in the center of the panel 20. The finger apertures 34 and 34' are cut in an identical manner on relatively short longitudinal lines 35, 35' and on semi-circular lines 36, 36' with the latter extending in the direction of the opposite side edges of the blank and interrupted by a pair of small, inwardly extending, bendable latching tabs 37 and 37' adjacent the ends of the lines 35 and 35'. Perforate lines 38, 38' are spaced inwardly of the side edges of the blank and extend between outboard portions of the cutting lines 27 and 28 of the outermost, or end pairs of apertures 30 and 32, which form bending lines for the outboard marginal portions 39, 39' of the panel 20.

The two blank sections 21 and 22 are cut and scored in an identical manner to provide, when set up, two pairs of upwardly inclined wall panels with apertures of their top fold line which have upwardly facing edge defining portions for engaging in supporting relation beneath the cap skirt S of the bottle caps C in the two rows of the bottles B. Since the blank sections 21 and 22, when cut and scored, are mirror images of each other, only blank section 21 will be described in detail. Elements of blank section 22 which correspond to elements of blank section 21 will be identified by the same numerals primed. The blank section 21 is divided by transverse score line 40 into outside and inside wall forming panels 42 and 43 of equal dimensions. The median score line 40 is interrupted by three spaced cap receiving apertures 44 of identical size and configuration each of which is formed by cutting on the line 45. Each aperture 44 has a general oval shape and provides upwardly facing edges for engaging beneath the downwardly facing edges of the cap skirt when the panels 42 and 43 are folded into the final position which is best shown in FIGS. 3 and 5. In addition, the panel material extending from the median score line 40 at each aperture 44 is scored to provide uniform bending or folding of the material, when applied to the bottle top. The material in the outside wall panel 42 adjacent each aperture 44 is scored on the lines 46 and 47 which extend in outwardly diverging relation from the intersection of the score line 40 with the aperture defining cutting line 45 to the end edge 18 of the blank. The material in the inner wall forming panel 43 adjacent the apertures 44 is scored in like manner on the lines 48 and 50 which extend from opposite ends of the aperture 44 to opposite ends of the cutting line 25. The panel material is bent or bowed outwardly of the panel outside faces when the device is applied to the bottles resulting in an upwardly opening truncated cone configuration with the edges of the material which define the aperture assuming a generally circular configuration so as to afford engagement of maximum portions of the edges of the material with the abutment forming downwardly facing edge portions of the cap skirt S.

The blank section 23 which forms a top wall panel has cut therein a row of three relatively small circular apertures 52 of identical size which are centered between the score lines 16 and 17 and spaced in the direction transversely of the blank 12 so as to align with the pairs of bottle neck and cap receiving apertures 30, 32, and 44, 44'. The panel material adjacent each aperture 52 is perforated or scored on pairs of lines 53, 54 and 55, 56, which extend in a generally radial direction relative to the circular cutting line for each aperture 52 to the transverse score lines 16 and 17. The innermost lines 53 and 54 terminate at the points of intersection of the score lines 46', 47' with the score line 16 while the outermost score lines 55 and 56 terminate at points on the score line 17 which are aligned approximately with the points of intersection of the lines 53 and 54 with the score line 16. The outboard perforation lines 53 and 55 are connected at their outboard ends by a perforated fold line 57. The perforated radial line arrangement is the same with respect to all three circular apertures 52 except for the line 57 which is not required in connection with the center aperture 52.

Finger aperture locking tabs 58 and 58' are cut in spaced relation in the center portion of the panel 23 which are aligned with the finger apertures 34 and 34' in the direction lengthwise of the blank and which are adapted to hinge on the score lines 60 and 60' as hereinafter described.

Certain portions of the blank which are not cut out to form the various apertures are scored on the transversely spaced, longitudinally extending, parallel lines 62, 63 and 64. These score lines are spaced according to the spacing of the bottles in the rows. They traverse the panels 21, 20, 22, 23 and 24 and cooperate with the adjacent score lines in forming the accordian-like folds hereinafter referred to when the carrier is assembled with the bottles.

Figure 7:
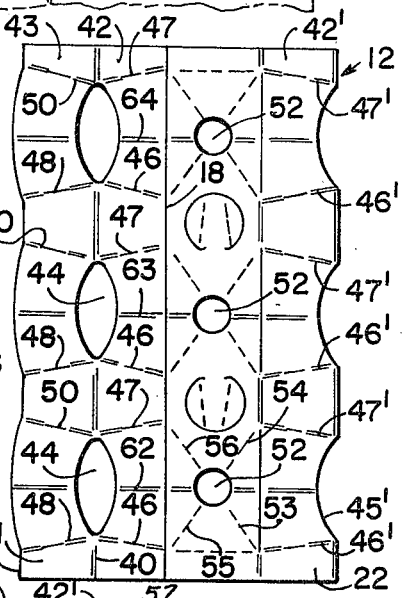
FIG. 7 is a plan view of the blank of FIG. 6 in folded and glued up condition in which it may be supplied to the bottling plant.
Figure 4:
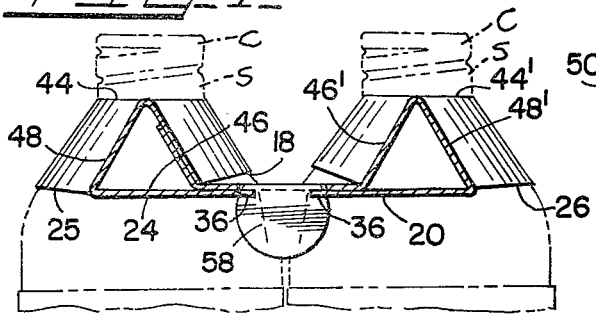
FIG. 4 is a cross sectional view taken on the line 4—4 of FIG. 2.

The cut and scored blank may be supplied to the bottling plant in the form shown in FIG. 6 but preferably it will be glued and folded so as to form a collapsed or flattened tube as shown in FIG. 7. Glue will be applied to the bottom surface of the panel 24 and the blank will be folded first on the transverse score lines 40 and then on the score line 14 which will bring the free end margin of the panel 21 into overlying relation with the glue bearing face of the panel 24.

In applying the collapsed carrier shown in FIG. 7 to an assembly of bottles it will be opened into a tubular configuration and the top wall panel depressed into engagement with the center portion of the bottom panel with the pairs of bottle neck engaging wall panels 42, 43 and 42', 43' in upstanding converging relation along opposite sides thereof. The tabs 58, 58' are hinged into the apertures 34, 34' to lock the panels 20 and 23 together. The carrier is then forced down over the bottle necks until the top edges of the walls defining the openings 44 and 44' engage beneath the bottom edges of the cap skirts. The enlargement of the openings 44 and 44' to receive the bottle tops results in a reduction in the length of the carrier with the wall forming panels folding in accordian fashion as shown in FIGS. 1 to 5. The bottle neck engaging wall panels bulge outwardly at each bottle while the top wall panel 23 and the portion of the bottom wall panel 20 on which it lies bulge downwardly in the areas between the pairs of bottle necks. The top and bottom panels are locked together, by depressing the tabs 34 and 34' into the apertures, and bulge downwardly between the pairs of bottle necks as shown in FIG. 5.

Figure 12:
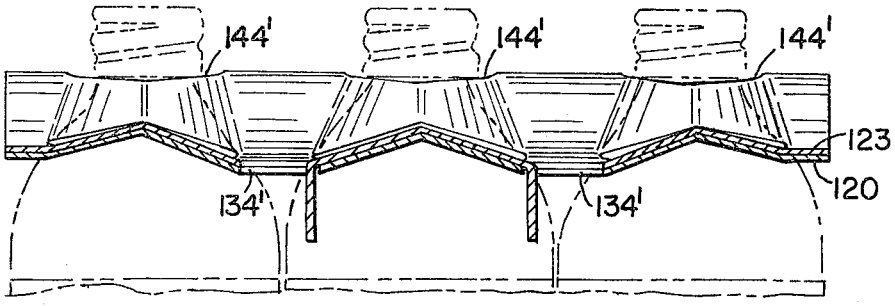
FIG. 12 is a cross sectional view taken on the line 12—12 of FIG. 9.
Figure 11:
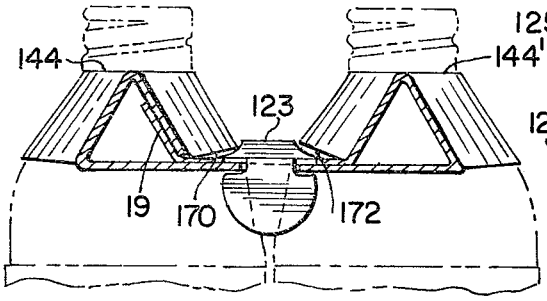
FIG. 11 is a cross sectional view taken on the line 11—11 of FIG. 9.
Figure 14:
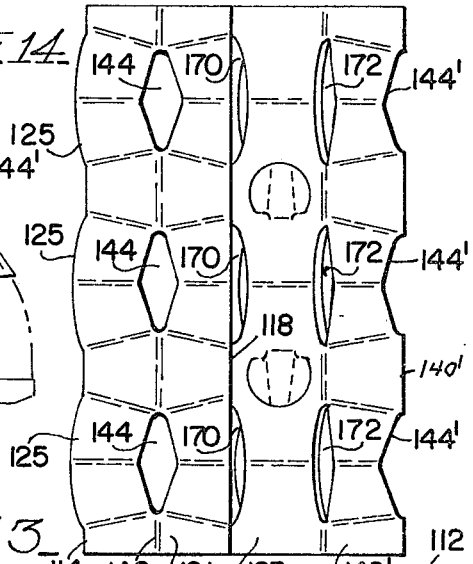
FIG. 14 is a plan view of the blank of FIG. 13 in folded and glued up condition in which it may be supplied to the bottling plant.
Figure 13:
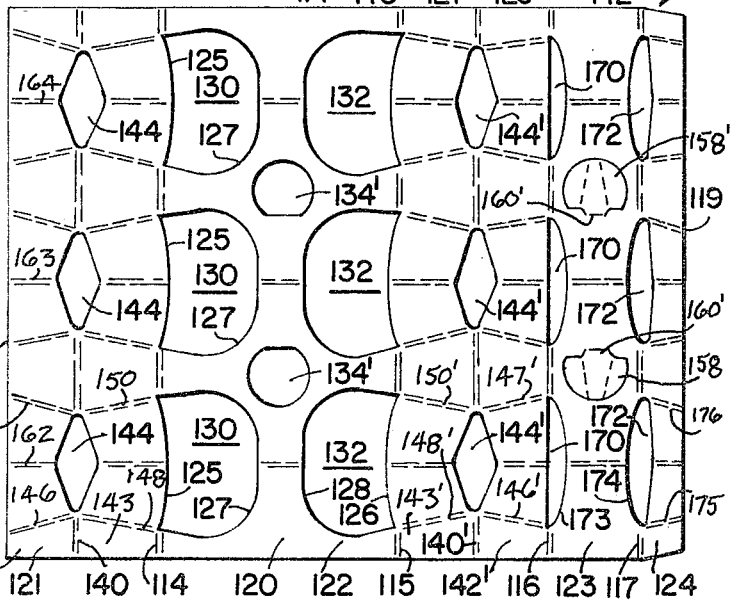
FIG. 13 is a plan view of a cut and scored blank for forming the bottle carrier of FIG. 8.

In the form of the carrier illustrated in FIGS. 8 to 14, the blank 112 is cut and scored as shown in FIG. 13. Longitudinally spaced transverse score lines 114, 115, 116 and 117, which are parallel with opposite end edge lines 118 and 119, divided the blank into a bottom wall forming section 120, adjoining cap gripping wall forming sections 121 and 122 of equal size, a top wall forming section 123 and a relatively narrow connecting glue panel 124 at the one end.

The transverse score lines 114 and 115 which define the bottom wall forming panel 120 are each interrupted by three transversely spaced cutting lines 125 and 126 of the same predetermined length which are disposed in spaced and aligned pairs in the direction lengthwise of the blank and which are slightly bowed in the direction inwardly of the panel 120. The cutting lines 125 and 126 connect at their opposite ends with the ends of generally C-shaped cutting lines 127 and 128 which are bowed in the same direction and to a much greater curvature relative to that of lines 125 and 126. These lines cooperate in defining the edges of apertures 130 and 132 which are arranged in two rows of three and in paired relation. The cutting lines 127 and 128 extend from the transverse score lines 114 and 115 toward the center of panel 120 and each pair thereof is spaced apart a predetermined distance. The apertures 130 and 132 correspond to the apertures 30 and 32 in FIG. 6 and are adapted to serve the same purpose. Finger accommodating apertures 134 and 134' are cut in the panels 20 which correspond to apertures 34 and 34' of FIG. 6.

The two blank sections 121 and 122 are cut and scored in an identical manner to provide, when set up, two pairs of upwardly inclined wall panels 142, 143 and 142', 143' which correspond to the wall panels 42, 43 and 42', 43' in FIG. 6, with center dividing cross-scores 140 and 140' on which the panels fold into inclined relation. The fold line scores 140 and 140' are interrupted by spaced cap receiving apertures 144 and 144' of the same general configuration as apertures 44 and 44' in FIG. 6 and dimensioned and spaced according to the dimensions and spacing of the tops of the bottles so as to accommodate the capped tops. The panel material extending from the score lines 140 and 140' adjacent the apertures 144 and 144' is scored on the lines 146, 147, 148, 150 and 146', 147', 148', 150' which correspond to lines 46, 47, 48, 50 and 46', 47', 48', 50' in FIG. and serve the same purpose, that is, when the carrier is applied to the bottles, the material in the panels is bowed outwardly with a resulting truncated cone configuration and with the apertures 144 and 144' assuming a general circular configuration so as to afford engagement of maximum portions of the upwardly facing edges with the abutment forming downwardly facing edge portions of each cap skirt.

The blank section 123 which forms the top wall panel has cut therein two rows of apertures 170 and 172, which are spaced transversely of the blank so as to align with the apertures 144 and 144' in the direction of the end edge 119 of the blank, and which interrupt the transverse score lines 116, 117 defining the panel 123. The cutting lines 173 and 174 defining the apertures 170 and 172 have a generally oval configuration as shown and extend a slight distance into the panels 142' and 124, with the long axes being somewhat longer than the corresponding axes of the apertures 144 and 144'. The panel 123 is proportioned or dimensioned so as to lie in the space between the rows of bottles when the carrier is assembled with the bottles and to overlie the corresponding portion of the bottom wall forming panel 120. Finger aperture locking tabs 158 and 158' are cut in the center portion of panel 123 which hinge on the score lines 160 and 160'. They are proportioned and positioned so that in the set up carrier, they may be swung downwardly about the hinge lines 160 and 160' into the finger apertures 134 and 134' and into locking relation therein as indicated in FIG. 12.

The blank is scored on the parallel, transversely spaced, longitudinal lines 162, 163 and 164 which traverse the panels 120, 121, 122, 123 and 124 and which are located so that in the set-up position of the carrier they are approximately in vertical planes passing through the vertical axes of the pairs of bottles and afford uniform outward bowing of the panel material surrounding the bottle necks.

The material in the connecting panel 124 at each aperture 172 is scored on the outwardly converging lines 175, 176 which extend from the ends of the apertures 172 to the end edge 119 of the blank. The lines 175, 176 are angled so as to align approximately with portions of the score lines 146, 147 in the set-up carrier.

The blank 112 is folded and its ends connected so as to form a collapsed tube similar to that shown in FIG. 7. The blank is first folded upon itself on the transverse score line 140' and an adhesive is applied to the connecting panel 124 after which the panel 121 is folded on the score line 114 which brings the end margin of the panel 121 into engagement in overlying relation with the adhesive bearing face of the connecting panel 124. The carrier is opened into tubular form and applied to the assembly of bottles in the same manner as described with reference to the form shown in FIG. 1, except that portions of the top wall panel 123 and the associated portions of the bottom wall panel 120 bow upwardly between the pairs of bottles upon formation of the accordian-like folds in the bottle engaging panels.

Figure 15:
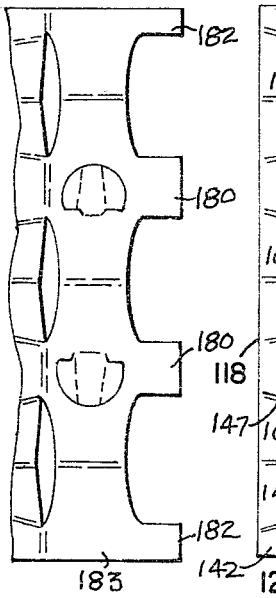
FIG. 15 is a plan view of an end portion of a cut and scored blank for forming a still further modified form of the carrier.

A modification of the carrier blank is illustrated in FIG. 15 which enables the formation of the carrier without any adhesives. As shown in FIG. 15, the blank is cut and scored the same as shown in FIG. 13 except that the end connecting panel 124 is eliminated and small tab-like extensions 180 and 182 on the margin of the top wall forming panel 183 are substituted which may be tucked beneath marginal portions of the terminal panel at the other end of the blank upon applying the blank to the assembly of bottles.

What is claimed is:

1. A carrying member for a group of articles in the form of bottles which have a substantial neck portion and a closure cap with a depending annular skirt formation, the bottles being arranged in double row transversely paired relation and the carrying member being formed of a cut and scored blank of paperboard, or similar foldable sheet material, which is divided into wall forming panels, folded about an assembly of the bottles and its ends connected so as to form when set up, a tube of generally rectangular cross section with a bottom wall forming panel having two parallel rows of spaced apertures disposed along opposite side margins of the panel, which apertures extend inwardly from the side edges of the panel and which are of a size and configuration so as to be positioned in encircling relation on the bottle necks in substantially spaced relation below the bottom edges of the cap skirts, said carrier including sidewall panels which extend upwardly of opposite side edges of said bottom wall panel and which are inclined inwardly thereof, said upwardly extending sidewall panels each having a hinged connection with a cooperating inner wall panel which extends downwardly with an inward inclination to a hinged connection with a top wall forming panel which is disposed in overlying relation to a central portion of the uppermost face of the bottom wall forming panel, said upwardly extending sidewall panels and associated inner wall panels having spaced apertures in the hinge line at the top edge of each of said panels of a size and configuration to engage the aperture defining edges of the panel material beneath the bottom edge of the cap skirts, said wall panels being scored in the direction relative to the direction of the rows of bottles so that upon forcing said carrier member down onto the top portions of the bottle, portions of the panels are folded in accordian fashion inwardly of the open ends of the carrier member.

2. A carrying member as set forth in claim 1 wherein the top and bottom wall forming panels have a pair of finger receiving apertures therein which are positioned and aligned so that the bottles may be carried when the member is positioned in cap engaging relation on the bottles.

3. A carrying member as set forth in claim 1 wherein the top and bottom wall forming panels are secured together by hinged tabs cut in the one wall forming panel and folded into cooperating apertures in the associated wall forming panel.

4. A carrying member as set forth in claim 1 wherein the top and bottom wall forming members have finger receiving apertures cut therein which are positioned and aligned and wherein said wall forming members are secured together by hinged tabs which are cut in the one wall member to provide the finger apertures and which are turned into the apertures in the associated wall member.

5. A carrying member as set forth in claim 1 wherein said top wall forming panel has portions disposed between each pair of bottles which are depressed below the normal level of intervening areas of the associated central portion of the bottom wall panel.

6. A carrying member as set forth in claim 1 wherein said top wall forming panel has portions disposed between each pair of bottles which are bowed upwardly relative to intervening portions of the associated central portion of the bottom wall panel.

7. A carrying member as set forth in claim 1 wherein the portions of said upwardly extending wall panels which depend from said cap accommodating apertures are scored so as to form a truncated cone configuration and encircle in part the neck portions of the bottles.

8. A carrying member as set forth in claim 1 wherein a marginal portion of said top wall forming panel constitutes a hinged connecting panel which is secured to the marginal portion of a downwardly inclined inner wall panel.

9. A carrying member as set forth in claim 1 wherein said top wall forming panel has connecting tab members on the free margin thereof which are inserted between the bottom marginal portion of a downwardly inclined inner wall panel and the confronting portions of the bottom wall forming panel.

10. A blank of foldable sheet material for forming a packaging device for an assembly of articles in the form of bottles with a neck portion and a closure cap on the mouth with a cap skirt having a downwardly facing bottom edge, which blank is generally rectangular and is cut and scored to provide a plurality of rectangular wall panels which are defined at least in part by hinge forming parallel score lines in spaced relation between end edges and which comprise a bottom wall forming panel having cut therein two rows of spaced apertures of a size to fit snugly adjacent the bottom portion of the neck of an article when positioned thereon and two pairs of inner and outer sidewall forming panels adjoining said bottom wall forming panel which have cut therein spaced apertures which interrupt median score lines forming hinged connections between the inner and outer sidewall forming panels, and each of which is aligned with an aperture in said bottom wall panel, a top wall forming panel adjoining an outer sidewall forming panel which is defined by two of said parallel score lines and a narrow connecting panel formation at the one end of the blank, said blank having spaced parallel score lines which are generally normal to said hinge forming score lines, which traverse said wall panels and which extend through said apertures.

11. A blank of foldable sheet material as set forth in claim 10 wherein said blank comprises a panel which is defined by two of said parallel hinge score lines, which adjoins an inner sidewall forming panel and which constitutes a top wall forming panel having marginal extensions for connecting opposite ends of the blank when the cut and scored blank is folded into a tubular formation.

12. A blank of foldable sheet material as set forth in claim 11 wherein said bottom wall panel has cut in the middle portion thereof a pair of finger accommodating apertures and said top wall forming panel has cut therein corresponding finger accommodating apertures positioned for alignment with the finger apertures in the bottom wall panel when the panels are folded into carrier forming relation.

13. A blank of foldable sheet material as set forth in claim 10 wherein said blank comprises a top wall forming panel adjoining one of said sidewall forming panels and an end marginal panel formation for connecting opposite ends of said blank when said panels are folded on said parallel score lines into a tubular formation.

14. A blank of foldable sheet material as set forth in claim 13 wherein said end marginal panel formation is in the form of spaced tab extensions on the outer edge of said top wall panel.

* * * * *

UNITED STATES PATENT AND TRADEMARK OFFICE

CERTIFICATE OF CORRECTION

PATENT NO. : 4,250,991

DATED : February 17, 1981

INVENTOR(S) : Manizza and Holmes

It is certified that error appears in the above—identified patent and that said Letters Patent is hereby corrected as shown below:

Column 4, line 20, after the word "parallel" insert -- end --.

Column 7, line 21 after the word "FIG." insert -- 6 --.

Signed and Sealed this

*Fourteenth* Day of *July 1981*

[SEAL]

*Attest:*

GERALD J. MOSSINGHOFF

*Attesting Officer*

*Commissioner of Patents and Trademarks*